US009784292B1

(12) United States Patent
Kunigk

(10) Patent No.: US 9,784,292 B1
(45) Date of Patent: Oct. 10, 2017

(54) PIN ASSEMBLY FOR A PISTON OF A HYDRAULIC CYLINDER

(71) Applicant: Caterpillar Inc., Peoria, IL (US)

(72) Inventor: Martin Kunigk, Bochum (DE)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 15/251,363

(22) Filed: Aug. 30, 2016

(51) Int. Cl.

| | |
|---|---|
| ***F15B 15/14*** | (2006.01) |
| ***F15B 15/22*** | (2006.01) |
| ***E02F 3/30*** | (2006.01) |
| ***E02F 3/42*** | (2006.01) |
| ***E02F 9/22*** | (2006.01) |

(52) U.S. Cl.
CPC ..... *F15B 15/223* (2013.01); *E02F 3/308* (2013.01); *E02F 3/425* (2013.01); *E02F 9/22* (2013.01); *F15B 15/1447* (2013.01)

(58) Field of Classification Search
CPC F15B 15/223; F15B 15/1447; F15B 15/1457; F15B 2015/1495; E02F 9/22; E02F 3/425; F02F 1/24
See application file for complete search history.

(56) References Cited

U.S. PATENT DOCUMENTS

| | | | | |
|---|---|---|---|---|
| 3,994,604 | A | 11/1976 | Visser | |
| 4,240,334 | A | 12/1980 | Crosser | |
| 6,487,955 | B1 | 12/2002 | Nishi | |
| 6,695,557 | B2 * | 2/2004 | Hove | F16B 37/14 292/307 B |
| 8,464,607 | B2 * | 6/2013 | Rhoades | F15B 15/1457 123/197.1 |

FOREIGN PATENT DOCUMENTS

| | | | |
|---|---|---|---|
| FR | 2463307 A1 * | 2/1981 | F15B 15/223 |
| KR | 101161306 | 7/2012 | |
| KR | 101424047 | 7/2014 | |
| WO | 2016039306 | 3/2016 | |

* cited by examiner

*Primary Examiner* — Logan Kraft
*Assistant Examiner* — Abiy Teka

(57) ABSTRACT

A pin assembly for a piston block of a hydraulic cylinder includes a pin that is axially engaged with the piston block. The pin assembly also includes a floating bush that is spaced apart from the pin to receive a sleeve therebetween. The floating bush is also configured to exhibit axial and radial play in its movement relative to the sleeve. The axial and radial play in the movement of the floating bush allows the floating bush to align with a cap port of the cylinder housing prior to entering the cap port of the cylinder housing.

19 Claims, 8 Drawing Sheets

PIN ASSEMBLY FOR A PISTON OF A HYDRAULIC CYLINDER

TECHNICAL FIELD

The present disclosure relates to a hydraulic cylinder. More particularly, the present disclosure relates to a pin assembly for a piston of a hydraulic cylinder.

BACKGROUND

Hydraulic cylinders typically include a piston slidably disposed within a cylinder. During operation, it may be beneficial to dampen a movement of the piston within the cylinder as the piston approaches a cap end of the cylinder so that an end face of the piston does not collide with the cap end of the cylinder. One method of accomplishing a damping effect on the movement of the piston as the piston approaches the cap end of the cylinder is to use a damping arrangement which, by way of an example, is disclosed in the Korean Patent 10-1161306 and provided to the piston for interfacing with an oil egress port located at the cap end of the cylinder.

However, as tight tolerances continue to be typically used in forming the known damping arrangements and the oil egress port of the cylinder for achieving the damping effect, it has been observed that under extreme working pressures, there could be a possibility of the known damping arrangements colliding with the oil egress port and/or the cap end of the cylinder and such known damping arrangements could, therefore, be prone to deterioration and/or failure.

Hence, there is a need for a pin assembly that is configured to mitigate the detrimental effects of tight tolerances encountered with use of previously known damping arrangements while also reliably providing a damping effect to the movement of the piston as the piston approaches the cap end of the cylinder.

SUMMARY OF THE DISCLOSURE

In an aspect of the present disclosure, a pin assembly for a piston rod of a hydraulic cylinder is provided. The hydraulic cylinder includes a cylinder housing defining a bore configured to receive the piston rod. The piston rod has a piston block defining a fore surface and an aft surface disposed on opposing sides of the piston block. The fore surface is configured to define a recess and a first threaded receptacle defined co-axial to the recess.

The pin assembly includes a pin that is disposed about a longitudinal axis, the longitudinal axis of the pin being configured to align with the recess. The pin includes a first threaded portion configured to releasably engage with the first threaded receptacle defined in a counterbored face adjacent to the recess of the piston block. The pin also includes a flanged portion having first and second opposing sides, the first opposing side being disposed adjacent to the first threaded portion such that the flanged portion is configured to be at least partly received within the recess. The pin further includes a support portion extending longitudinally from the second opposing side of the flanged portion. The support portion defines a second threaded portion disposed at least partway along a length of the support portion.

The pin assembly further includes a floating bush disposed about the support portion and located in a spaced apart relation to the support portion. The floating bush has a first end and a second end, the first end being located proximal to the second opposing side of the flanged portion.

The pin assembly further includes a sleeve having a shank received between the floating bush and the support portion of the pin. The shank has a plurality of internal threads configured to releasably engage with the second threaded portion of the pin. The sleeve also includes a stop flange disposed on an outer circumference of the shank and located proximal to a second end of the floating bush. The sleeve further includes a polygonal head disposed on the outer circumference of the sleeve and located adjacent to the stop flange.

In another aspect of the present disclosure, a hydraulic cylinder for a machine includes a cylinder housing axially defining a bore therein, and a piston rod received in the bore of the cylinder housing. The piston rod has a piston block defining a fore surface and an aft surface disposed on opposing sides of the piston block. The fore surface defining a recess and a first threaded receptacle defined co-axial to the recess. The hydraulic cylinder also includes the pin assembly disclosed herein.

In yet another aspect of the present disclosure, a machine having a frame, a boom pivotally supported on the frame, and a stick pivotally supported on the boom. The machine further includes a hydraulic cylinder in accordance with embodiments disclosed herein. The hydraulic cylinder is coupled to the boom and the stick. The hydraulic cylinder is configured to operatively move the stick in relation to the boom.

Other features and aspects of this disclosure will be apparent from the following description and the accompanying drawings.

DETAILED DESCRIPTION

Figure 1:
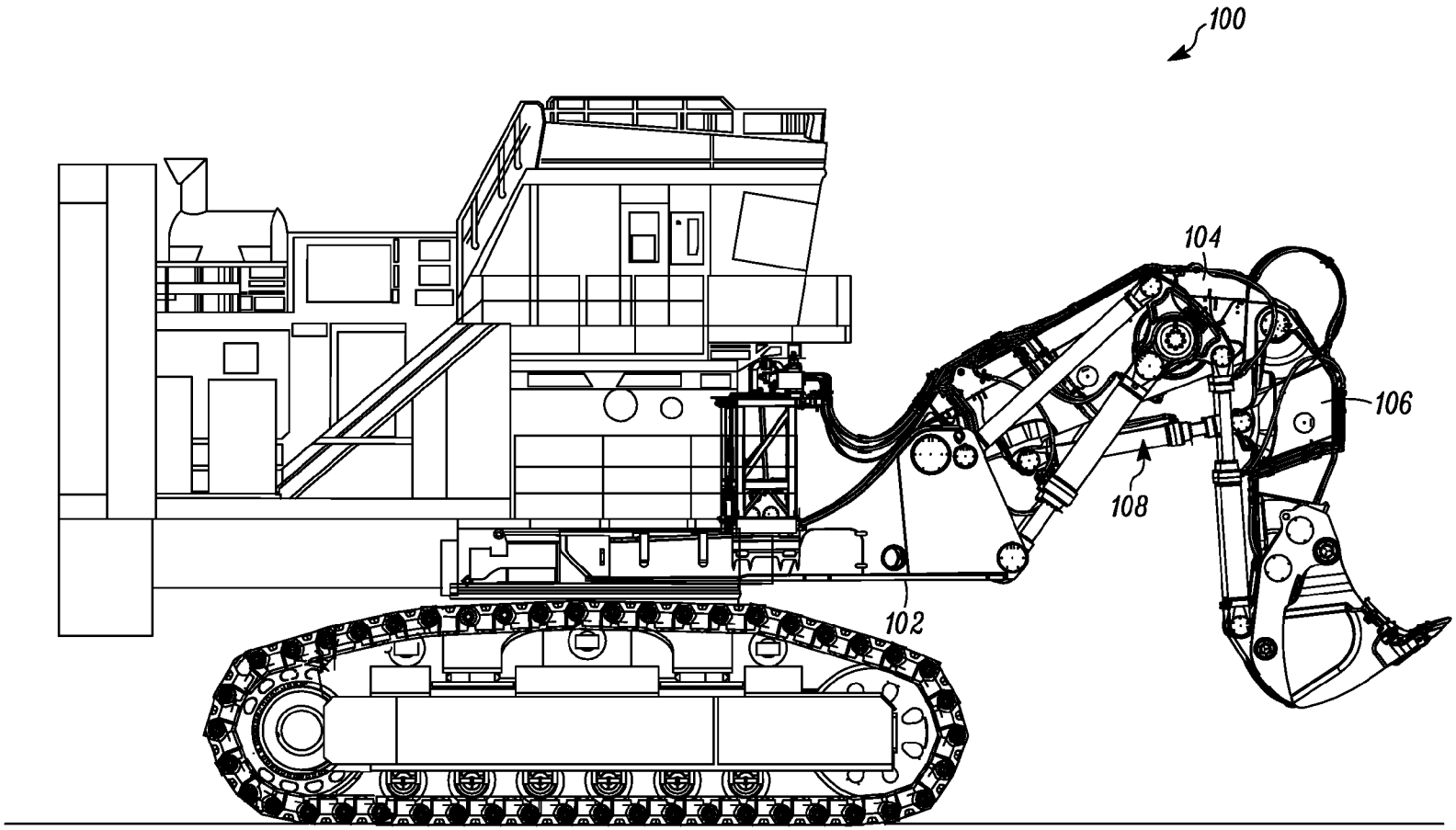
FIG. 1 is a diagrammatic view of an exemplary machine, in which embodiments of the present disclosure can be implemented.

Wherever possible, the same reference numbers will be used throughout the drawings to refer to same or like parts. FIG. 1 illustrates an exemplary machine 100 that is embodied in the form of a hydraulic excavator. As shown, the machine 100 includes a frame 102, a boom 104 pivotally supported on the frame 102, and a stick 106 pivotally supported on the boom 104. The machine 100 also includes a hydraulic cylinder 108 that is coupled to the boom 104 and the stick 106. The hydraulic cylinder 108 is configured to operatively move the stick 106 in relation to the boom 104. The hydraulic cylinder 108 may be operable using pressurized fluid power from a source (not shown), for example, a hydraulic pump, a hydraulic motor, or any other type of power source known to persons skilled in the art.

Although the present disclosure discloses that the hydraulic cylinder 108 is associated with boom 104 and the stick 106 to operatively bring about a movement of the stick 106 in relation to the boom 104, it may be noted that a location of the hydraulic cylinder 108 on the machine 100 is non-limiting of this disclosure. Persons skilled in the art will recognize that the hydraulic cylinder 108 disclosed herein may alternatively be employed at a different location on the machine 100, for example, the hydraulic cylinder 108 may be provided between the frame 102 and the boom 104 to control a movement of the boom 104 relative to the frame 102, or at any other location on the machine 100 depending on specific requirements of an application.

Further, although a hydraulic excavator is disclosed herein, it may be noted that the hydraulic excavator is merely exemplary in nature. It will be appreciated by persons skilled in the art that embodiments disclosed herein may be similarly applied to other types of machines that typically employ a hydraulic cylinder 108. Some examples of machines that typically use a hydraulic cylinder, in which embodiments of the present disclosure can be implemented, may include mining shovels, on-highway trucks, off-highway trucks, articulated trucks, diggers, or augers, but are not limited thereto.

Figure 2:
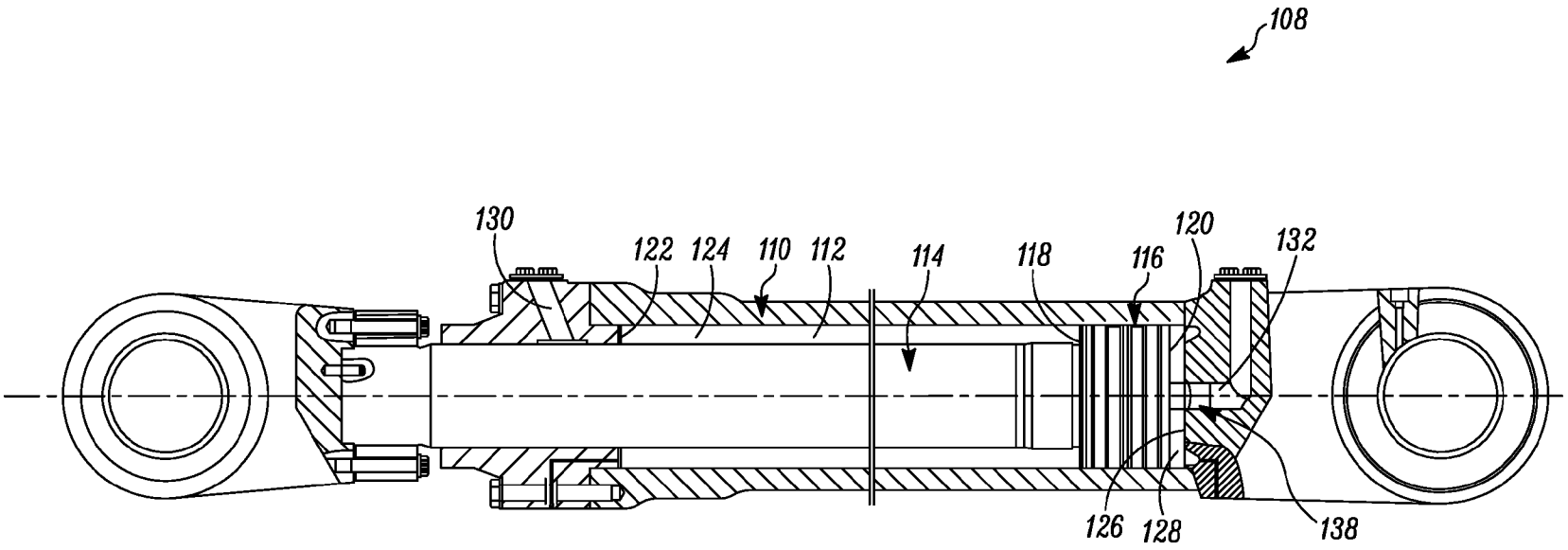
FIG. 2 is a breakaway view of a hydraulic cylinder, in accordance with embodiments of the present disclosure.

Referring to FIG. 2, the hydraulic cylinder 108 includes a cylinder housing 110 axially defining a bore 112 therein. The hydraulic cylinder 108 also includes a piston rod 114 received in the bore 112 of the cylinder housing 110. The piston rod 114 has a piston block 116 defining a fore surface 120 and an aft surface 118 disposed on opposing sides of the piston block 116. The aft surface 118 of the piston block 116 and a head end 122 of the cylinder housing 110 together define a rod chamber 124. Likewise, the fore surface 120 of the piston block 116 and a cap end 126 of the cylinder housing 110 together define a piston chamber 128. Further, the cylinder housing 110 is provided with a pair of ports—i.e., a head port 130 and a cap port 132. The head port 130 is disposed in fluid communication with the rod chamber 124 while the cap port 132 is disposed in fluid communication with the piston chamber 128 of the hydraulic cylinder 108.

During operation, movement of the piston rod 114 towards the cap end 126 of the cylinder housing 110 may be accomplished by routing pressurized fluid in the head port 130 that is disposed in fluid communication with the rod chamber 124 of the hydraulic cylinder 108. Similarly, movement of the piston rod 114 towards the head end 122 of the cylinder housing 110 may be accomplished by routing pressurized fluid in the cap port 132 that is disposed in fluid communication with the piston chamber 128 of the hydraulic cylinder 108.

Figure 3:
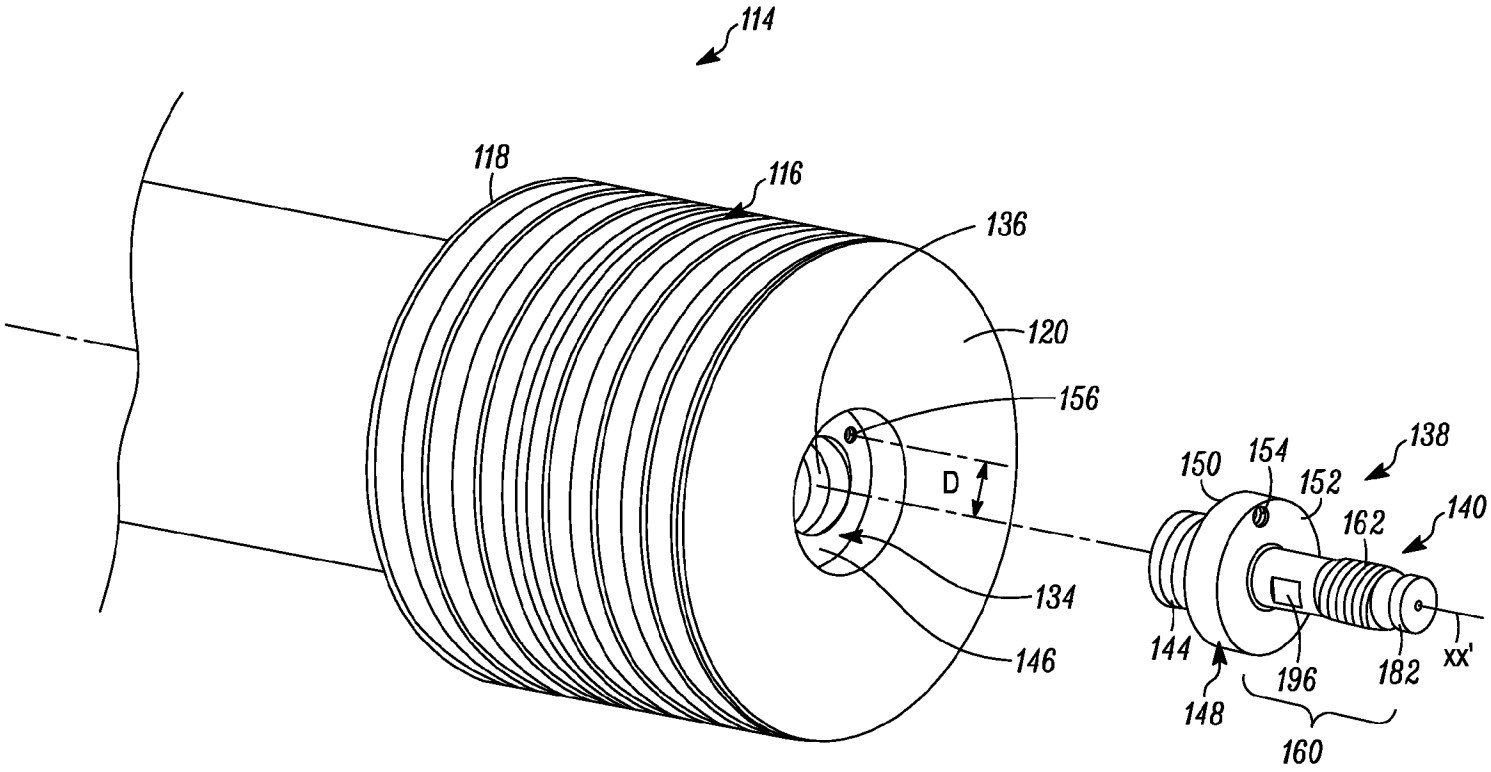
FIG. 3 is an exploded view of a piston rod showing a piston block to which a pin of a pin assembly is assembled, in accordance with an embodiment of the present disclosure.

Referring to FIGS. 2-3, the fore surface 120 of the piston block 116 defines a recess 134 and a first threaded receptacle 136 located co-axial to the recess 134. The hydraulic cylinder 108 also includes a pin assembly 138 that is shown in the sectional view of FIG. 2 herein. The pin assembly 138 includes numerous components that are shown in the assembled view of FIG. 8 and explanation to which is made in the appended disclosure.

With continued reference to FIGS. 2-3, the pin assembly 138 includes a pin 140 that is disposed about a longitudinal axis XX', the longitudinal axis XX' of the pin 140 being configured to axially align with the recess 134 and, in particular, with the first threaded receptacle 136. The pin 140 includes a first threaded portion 144 configured to releasably engage with the first threaded receptacle 136 defined in a counterbored face 146 and which is located adjacent to the recess 134 of the piston block 116. The pin 140 also includes a flanged portion 148 having first and second opposing sides 150, 152. The first opposing side 150 is disposed adjacent to the first threaded portion 144 such that upon engaging the first threaded portion 144 with the first threaded receptacle 136, the flanged portion 148 of the pin is at least partly received within the recess 134.

In embodiments of this disclosure, it has also been contemplated to provide a pair of slotted grooves 196 (refer to FIG. 3) on the support portion 160 of the pin 140. The slotted grooves 196 are configured to allow use of one or more types of hand-operated or power-operated tools (not shown) e.g., a torque wrench for rotatively engaging or disengaging the pin 140 with the piston block 116. Although the pair of slotted grooves 196 are disclosed herein, numerous other types of functionally equivalent features are readily known in the art and such numerous other types of functionally equivalent features may be readily implemented by persons skilled in the art to allow use of hand-operated or power-operated tools in rotatively engaging or disengaging the pin 140 with the piston block 116.

Figure 4:
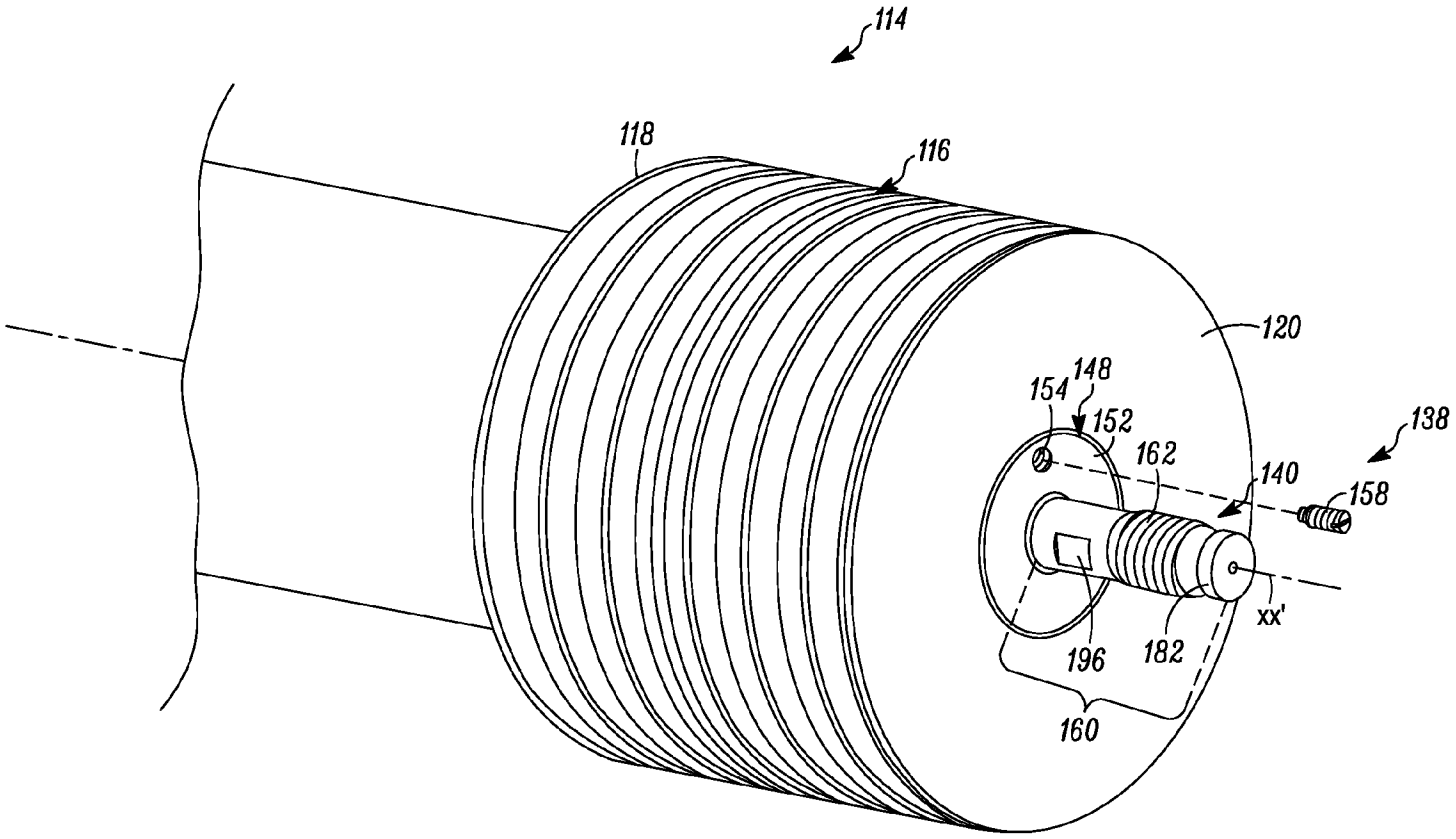
FIG. 4 is an exploded view of the piston block to which a first fastener is threadably engaged to secure the pin from rotating relative to the piston block, in accordance with an embodiment of the present disclosure.

Referring to FIGS. 3-4, the flanged portion 148 includes a second threaded receptacle 154 extending between the first and second opposing sides 150, 152 of the flanged portion 148. The second threaded receptacle 154 is obtained by performing commonly known operations including, but not limited to, drilling and tapping on the flanged portion 148 of the pin 140. A third receptacle 156 is also formed on the counterbored face 146 of the piston block 116 adjacent to the recess 134 (refer to FIG. 3). The third receptacle 156 is offset with the first threaded receptacle 136 of the piston block 116 by a distance D. The third receptacle 156 in the counterbored face 146 of the piston block 116 is configured to align with the second threaded receptacle 154 on the flanged portion 148 of the pin 140.

In embodiments of this disclosure, it has been contemplated that the third receptacle 156 may be formed after threadably engaging the first threaded portion 144 of the pin 140 with the first threaded receptacle 136 of the piston block 116, then drilling and tapping the flanged portion 148 of the pin 140 to form the second threaded receptacle 154, and thereafter drilling the counterbored face 146 of the piston block 116 to form the third receptacle 156 in axial alignment with the second threaded receptacle 154 on the flanged portion 148 of the pin 140.

Conversely, it can also be contemplated that if an amount of torque required on the pin 140 for securing the first threaded portion 144 of the pin 140 with the first threaded receptacle 136 of the piston block 116 is known before-hand, then a location of the third receptacle 156 on the counterbored face 146 of the piston block 116 may also be selected prior to assembly of the pin 140 with the first threaded receptacle 136 such that the third receptacle 156 on the counterbored face 146 of the piston block 116 aligns with the second threaded receptacle 154 on the flanged portion 148 of the pin 140. Referring to FIGS. 3-4, the pin assembly 138 further includes a first fastener 158 that is configured to releasably engage with the second threaded receptacle 154 and be at least partly received within the third receptacle 156 upon mutual alignment of the second threaded receptacle 154 and the third receptacle 156. The first fastener 158 is configured to restrict a rotational movement of the pin 140 with respect to the piston block 116.

In the illustrated embodiment of FIG. 4, the first fastener 158 is embodied in the form of a grub screw. In an alternative embodiment, it can be contemplated to use an Allen screw in lieu of the grub screw disclosed herein. It may be noted that a specific configuration of the first fastener 158 is non-limiting of this disclosure. Rather, persons skilled in the art will acknowledge that numerous configurations of fasteners are known in the art and such configurations of fasteners may be readily implemented in place of the grub screw and the Allen screw disclosed herein to restrict rotational movement of the pin 140 with respect to the piston block 116.

Referring to FIGS. 3-4, the pin 140 further includes a support portion 160 extending longitudinally from the second opposing side 152 of the flanged portion 148. The support portion 160 defines a second threaded portion 162 disposed at least partway along a length of the support portion 160.

Figure 5:
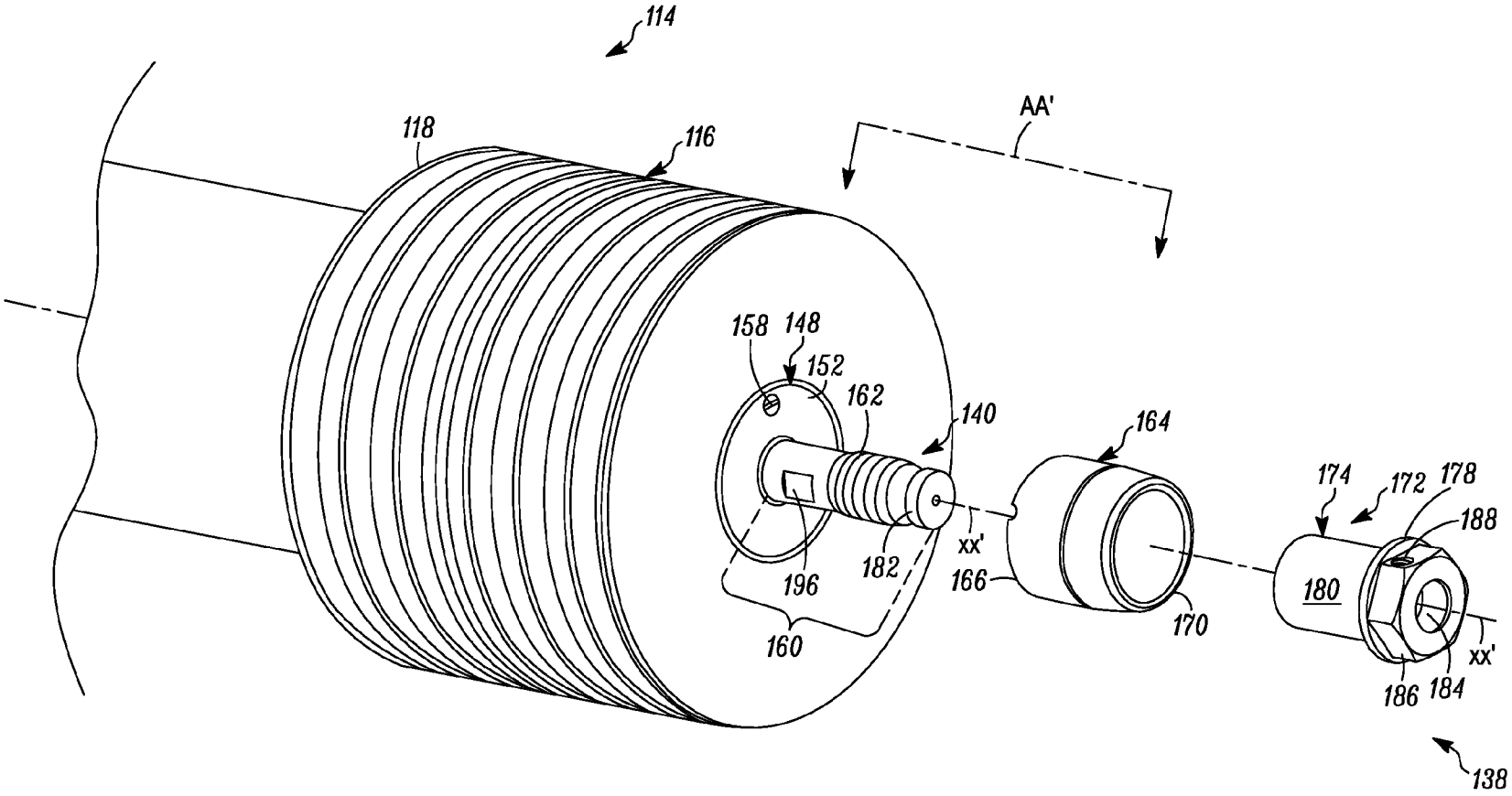
FIG. 5 is an exploded view of the piston block showing the pin assembly in which a floating bush and a threaded sleeve are being assembled with the pin, in accordance with an embodiment of the present disclosure.
Figure 6:
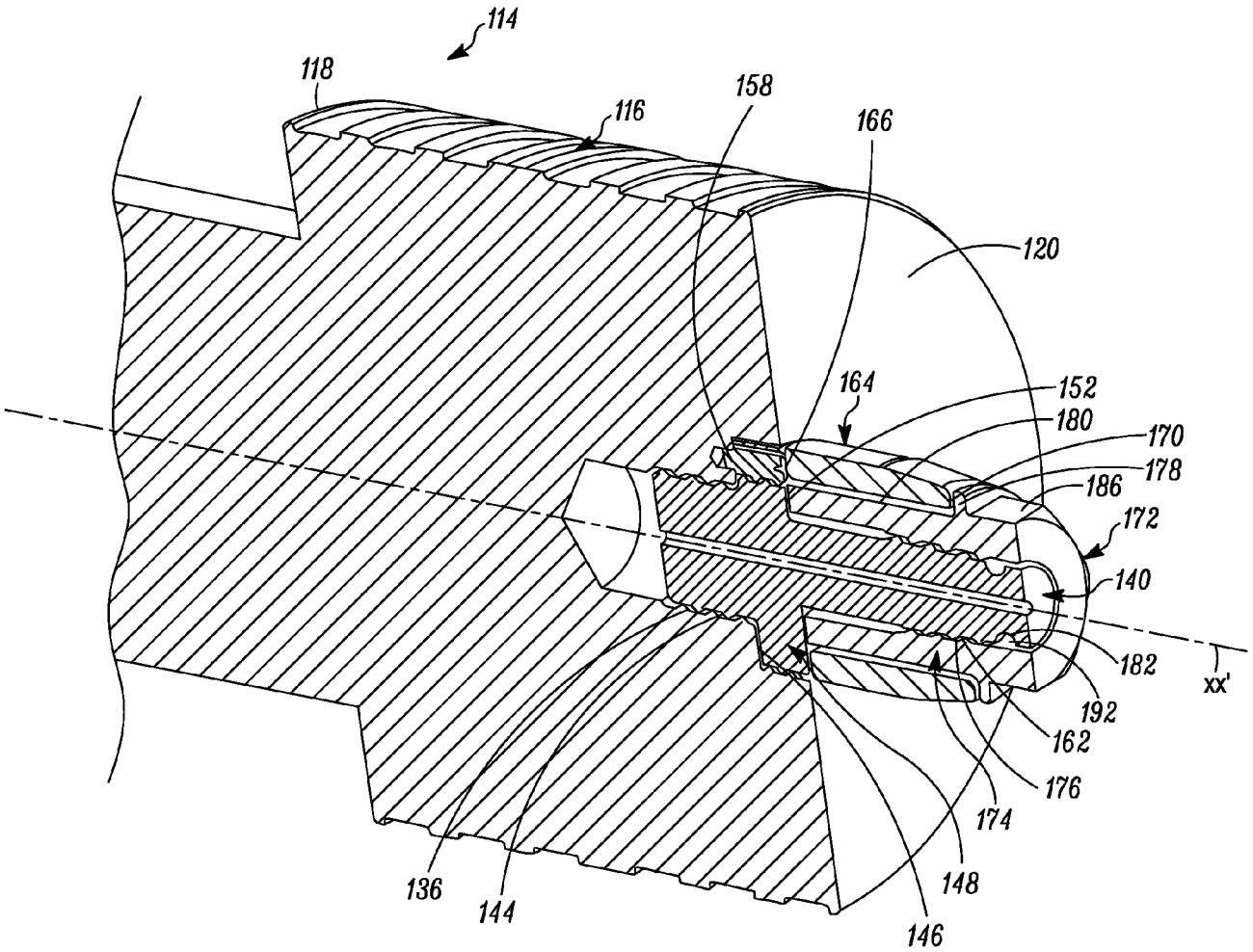
FIG. 6 is a sectional view taken along line AA' of the piston rod from FIG. 5, in accordance with an embodiment of the present disclosure.

Referring to FIGS. 5-6, the pin assembly 138 further includes a floating bush 164 disposed about the support portion 160 and located in a spaced apart relation to the support portion 160. The floating bush 164 has a first end 166 and a second end 170, the first end 166 being located proximal to the second opposing side 152 of the flanged portion 148.

With continued reference to FIGS. 5-6, the pin assembly 138 further includes a sleeve 172 having a shank 174 that is received between the floating bush 164 and the support portion 160 of the pin 140. The shank 174 has a plurality of internal threads 176 configured to releasably engage with the second threaded portion 162 of the pin 140. The sleeve 172 also includes a stop flange 178 disposed on an outer circumference 180 of the shank 174 and located proximal to the second end 170 of the floating bush 164.

As shown in FIG. 6, the pin 140 further includes a locking portion 182 disposed distally from the flanged portion 148 and located adjacent to the second threaded portion 162. Also, the shank 174 further includes an inner circumference 184 disposed in opposing relation to the outer circumference 180. The inner circumference 184 is configured to be in a spaced-apart relation with the locking portion 182.

Figure 7:
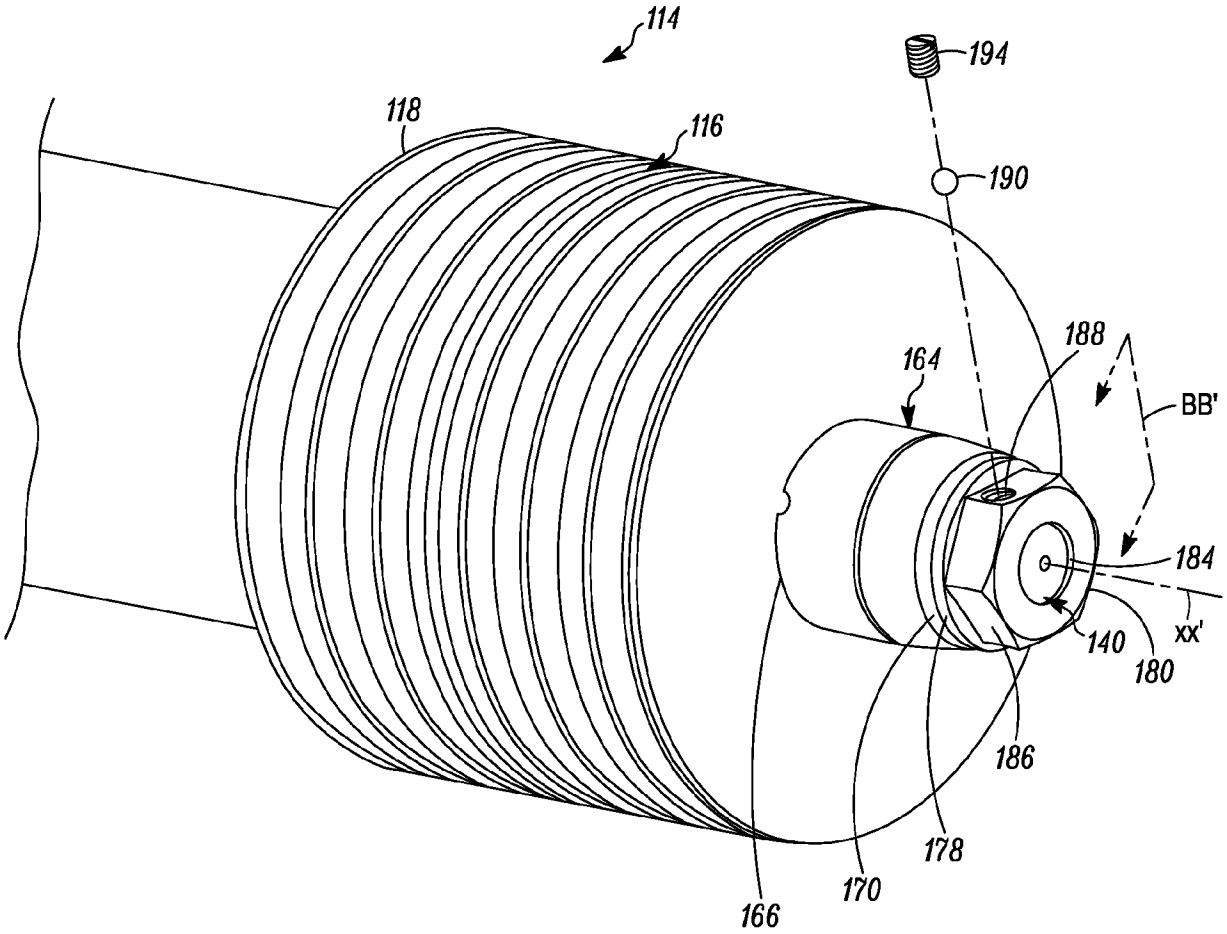
FIG. 7 is an exploded view of the piston block showing a head of the sleeve defining a fourth threaded receptacle through which a locking element is received, in accordance with an embodiment of the present disclosure.
Figure 8:
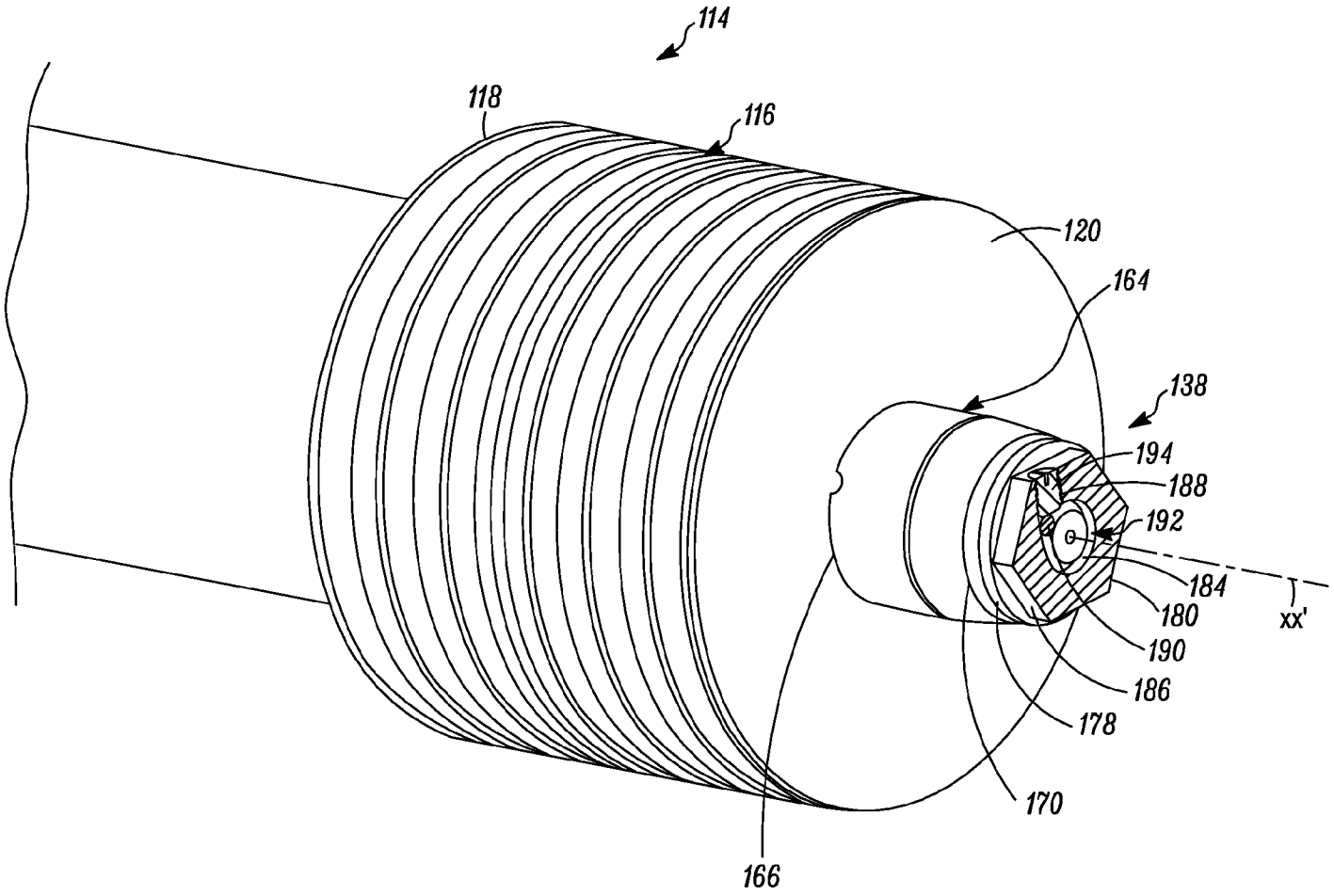
FIG. 8 is a sectional view taken along line BB' of the piston rod from FIG. 7, in accordance with an embodiment of the present disclosure.

Referring to FIGS. 5-8, the sleeve 172 further includes a polygonal head 186 disposed on the outer circumference 180 of the sleeve 172 and located adjacent to the stop flange 178. As shown in FIGS. 5, 7 and 8, the head 186 further includes a fourth threaded receptacle 188 extending between the outer circumference 180 and the inner circumference 184 of the sleeve 172. The fourth threaded receptacle 188 is laterally disposed in relation to the longitudinal axis XX' of the pin 140. Moreover, as shown in FIGS. 7-8, a locking element 190 is received through the fourth threaded receptacle 188 and disposed in an annular region 192 (also shown in the cross-sectional view of FIG. 6) defined between the inner circumference 184 of the shank 174 and the locking portion 182 of the pin 140. Referring to FIGS. 6-8, the locking element 190 is configured to prevent the internal threads 176 on the shank 174 from disengaging with the second threaded portion 162 of the pin 140. By preventing a disengagement between the internal threads 176 of the shank 174 from the second threaded portion 162 of the pin 140, the locking element 190 restricts an axial movement of the sleeve 172 in relation to the pin 140.

In the illustrated embodiment of FIGS. 7-8, the locking element 190 is embodied in the form of a spherical ball. However, in other embodiments, other shapes including, but not limited to, elliptical, cubic, cuboidal may be used to form the locking element 190 in place of the spherical ball disclosed herein. Persons skilled in the art will appreciate that any shape and size may be used to correspond with space constraints associated with the annular region 192 defined between the inner circumference 184 of the shank 174 and the locking portion 182 of the pin 140.

Further, as shown in FIGS. 7-8, the pin assembly 138 further includes a second fastener 194 that is configured to releasably engage with the fourth threaded receptacle 188. The second fastener 194 is configured to secure the locking element 190 within the annular region 192 and hence, prevent the locking element 190 from falling out of the fourth threaded receptacle 188. In the illustrated embodiment of FIGS. 7-8, the second fastener 194 is embodied in the form of a grub screw. In an alternative embodiment, it can be contemplated to use an Allen screw in lieu of the grub screw disclosed herein. It may be noted that a specific configuration of the second fastener 194 is non-limiting of this disclosure. Rather, persons skilled in the art will acknowledge that numerous configurations of fasteners are known in the art and such configurations of fasteners may be readily implemented in place of the grub screw and the Allen screw disclosed herein to secure the locking element 190 within the annular region 192 and therefore, assist the locking element 190 in restricting an axial movement of the sleeve 172 with respect to the pin 140.

During operation of the hydraulic cylinder 108, the floating bush 164 of the pin assembly 138 is configured to be slidably received within the cap port 132 of the cylinder housing 110 as the fore surface 120 of the piston block 116 approaches the cap end 126 of the cylinder housing 110. As the first and second ends 166, 170 of the floating bush 164 are disposed in a spaced-apart relation with the flanged portion 148 of the pin 140 and the stop flange 178 of the pin 140 respectively, axial play is introduced in the movement of the floating bush 164 relative to the sleeve 172. Further, by configuring the inner circumference 184 of the floating bush 164 to be disposed in a spaced-apart relation to the shank 174 of the sleeve 172, radial play is introduced in the movement of the floating bush 164 relative to the sleeve 172. It is envisioned that by incorporating radial play in the movement of the floating bush 164 relative to the shank 174 of the sleeve 172 and axial play in the movement of the floating bush 164 between the flanged portion 148 of the pin 140 and the stop flange 178 of the sleeve 172, the floating bush 164 can easily move to align with the cap port 132 (See FIG. 2) prior to entering the cap port 132 of the cylinder housing 110 when the piston block 116 approaches the cap end 126 of the cylinder housing 110.

Various embodiments disclosed herein are to be taken in the illustrative and explanatory sense, and should in no way be construed as limiting of the present disclosure. All joinder references (e.g., attached, affixed, coupled, engaged, connected, and the like) are only used to aid the reader's understanding of the present disclosure, and may not create limitations, particularly as to the position, orientation, or use of the systems and/or methods disclosed herein. Therefore, joinder references, if any, are to be construed broadly. Moreover, such joinder references do not necessarily infer that two elements are directly connected to each other.

Additionally, all numerical terms, such as, but not limited to, "first", "second", "third", "primary", "secondary" or any other ordinary and/or numerical terms, should also be taken only as identifiers, to assist the reader's understanding of the various elements, embodiments, variations and/or modifications of the present disclosure, and may not create any limitations, particularly as to the order, or preference, of any element, embodiment, variation and/or modification relative to, or over, another element, embodiment, variation and/or modification.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

Embodiments of the present disclosure have applicability for use and implementation in providing a damping effect to a movement of a piston rod within a hydraulic cylinder.

With use of the pin assembly 138 disclosed herein, a movement of the piston block 116 towards the cap end 126 of the cylinder housing 110 can be smoothly damped by allowing the floating bush 164 to align with the cap port 132 of the cylinder housing 110 prior to entering the cap port 132. The axial and radial play introduced in the size of the floating bush 164 in relation to respective ones of the flanged portion 148 of the pin 140, the stop flange 178, and the shank 174 of the sleeve 172 helps the floating bush 164 to execute movement under the influence of fluid pressure in piston chamber 128 of the cylinder housing 110 as the piston block 116 approaches the cap end 126 of the cylinder housing 110. This way, collisions and other detrimental effects arising from tight tolerances typically used in forming previously known damping arrangements may be mitigated. Also, costs, time, and effort incurred on manufacture, repair, or replacement of previously known damping arrangements and/or piston blocks can be minimized with use of the pin assembly 138 disclosed herein.

While aspects of the present disclosure have been particularly shown and described with reference to the embodiments above, it will be understood by those skilled in the art that various additional embodiments may be contemplated by the modification of the disclosed machines, systems, methods and processes without departing from the spirit and scope of what is disclosed. Such embodiments should be understood to fall within the scope of the present disclosure as determined based upon the claims and any equivalents thereof.

What is claimed is:

1. A pin assembly for a piston block of a hydraulic cylinder, the hydraulic cylinder having a cylinder housing defining a bore configured to receive a piston rod therein, the piston rod bearing the piston block, the piston block defining a fore surface and an aft surface disposed on opposing sides of the piston block, the fore surface defining a recess and a first threaded receptacle disposed co-axial to the recess, the pin assembly comprising:

a pin disposed about a longitudinal axis, the longitudinal axis of the pin being configured to align with the recess, the pin comprising:

a first threaded portion configured to releasably engage with the first threaded receptacle defined in a counterbored face adjacent to the recess of the piston block;

a flanged portion having first and second opposing sides, the first opposing side being disposed adjacent to the first threaded portion, the flanged portion configured to be at least partly received within the recess, wherein the flanged portion includes a second threaded receptacle extending between the first and second opposing sides of the flanged portion; and a support portion extending longitudinally from the second opposing side of the flanged portion, the support portion defining a second threaded portion disposed at least partway along a length of the support portion; and a floating bush disposed about the support portion and located in a spaced apart relation to the support portion, the floating bush having a first end and a second end, the first end being located proximal to the second opposing side of the flanged portion; and a sleeve comprising:

a shank received between the floating bush and the support portion of the pin, the shank having a plurality of internal threads configured to releasably engage with the second threaded portion of the pin;

a stop flange disposed on an outer circumference of the shank and located proximal to the second end of the floating bush; and a polygonal head disposed on the outer circumference of the sleeve and located adjacent to the stop flange.

2. The pin assembly of claim 1 further comprising a first fastener configured to releasably engage with the second threaded receptacle.

3. The pin assembly of claim 2, wherein the first fastener is one of a grub screw and an Allen screw.

4. The pin assembly of claim 1, wherein the pin further includes a locking portion disposed distally from the flanged portion and located adjacent to the second threaded portion.

5. The pin assembly of claim 4, wherein the shank further comprises an inner circumference disposed in opposing relation to the outer circumference, the inner circumference being configured to be in a spaced-apart relation with the locking portion.

6. The pin assembly of claim 5, wherein the head further comprises a fourth threaded receptacle extending between the outer circumference of the sleeve and the inner circumference of the sleeve, the fourth threaded receptacle being laterally disposed in relation to the longitudinal axis of the pin.

7. The pin assembly of claim 6 further comprising a locking element received through the fourth threaded receptacle and disposed in an annular region defined between the inner circumference of the shank and the locking portion of the pin.

8. The pin assembly of claim 7 further comprising a second fastener configured to releasably engage with the fourth threaded receptacle.

9. The pin assembly of claim 8, wherein the second fastener is one of a grub screw and an Allen screw.

10. A hydraulic cylinder for a machine, the hydraulic cylinder comprising:

a cylinder housing axially defining a bore therein;

a piston rod received in the bore of the cylinder housing, the piston rod having a piston block defining a fore surface and an aft surface disposed on opposing sides of the piston block, the fore surface defining a recess and a first threaded receptacle defined co-axial to the recess; and a pin assembly disposed at the fore surface of the piston block, the pin assembly comprising:

a pin disposed about a longitudinal axis, the longitudinal axis of the pin being configured to align with the recess, the pin comprising:

a first threaded portion configured to releasably engage with the first threaded receptacle defined in a counterbored face adjacent to the recess of the piston block;

a flanged portion having first and second opposing sides, the first opposing side being disposed adjacent to the first threaded portion, the flanged portion configured to be at least partly received within the recess; and a support portion extending longitudinally from the second opposing side of the flanged portion, the support portion defining a second threaded portion disposed at least partway along a length of the support portion; and a floating bush disposed about the support portion and located in a spaced apart relation to the support portion, the floating bush having a first end and a second end, the first end being located proximal to the second opposing side of the flanged portion; and a sleeve comprising:

a shank received between the floating bush and the support portion of the pin, the shank having a plurality of internal threads configured to releasably engage with the second threaded portion of the pin;

a stop flange disposed on an outer circumference of the shank and located proximal to the second end of the floating bush; and a polygonal head disposed on the outer circumference of the sleeve and located adjacent to the stop flange.

11. The hydraulic cylinder of claim 10, wherein the flanged portion includes a second threaded receptacle extending between the first and second opposing sides of the flanged portion.

12. The hydraulic cylinder of claim 11, wherein the pin assembly further comprises a first fastener configured to releasably engage with the second threaded receptacle.

13. The hydraulic cylinder of claim 12, wherein the counterbored face of the piston block is further configured to define a third receptacle in alignment with the second threaded receptacle, the third receptacle configured to at least partly receive the first fastener therein.

14. The hydraulic cylinder of claim 10, wherein the pin further includes a locking portion disposed distally from the flanged portion and located adjacent to the second threaded portion.

15. The hydraulic cylinder of claim 14, wherein the shank further comprises an inner circumference disposed in opposing relation to the outer circumference, the inner circumference being configured to be in a spaced-apart relation with the locking portion.

16. The hydraulic cylinder of claim 15, wherein the head further comprises a fourth threaded receptacle extending between the outer circumference of the sleeve and the inner circumference of the sleeve, the fourth threaded receptacle being laterally disposed in relation to the longitudinal axis of the pin.

17. The hydraulic cylinder of claim 16, wherein the pin assembly further comprises a locking element received through the fourth threaded receptacle and disposed in an annular region defined between the inner circumference of the shank and the locking portion of the pin.

18. The hydraulic cylinder of claim 17, wherein the pin assembly further comprises a second fastener configured to releasably engage with the fourth threaded receptacle.

19. A machine comprising:

a frame;

a boom pivotally supported on the frame;

a stick pivotally supported on the boom; and a hydraulic cylinder coupled to the boom and the stick, the hydraulic cylinder configured to operatively move the stick in relation to the boom, the hydraulic cylinder comprising:

a cylinder housing axially defining a bore therein;

a piston rod received in the bore of the cylinder housing, the piston rod having a piston block defining a fore surface and an aft surface disposed on opposing sides of the piston block, the fore surface defining a recess and a first threaded receptacle defined co-axial to the recess; and a pin assembly disposed at the fore surface of the piston block, the pin assembly comprising:

a pin disposed about a longitudinal axis, the longitudinal axis of the pin being configured to align with the recess, the pin comprising:

a first threaded portion configured to releasably engage with the first threaded receptacle defined in a counterbored face adjacent to the recess of the piston block;

a flanged portion having first and second opposing sides, the first opposing side being disposed adjacent to the first threaded portion, the flanged portion configured to be at least partly received within the recess; and a support portion extending longitudinally from the second opposing side of the flanged portion, the support portion defining a second threaded portion disposed at least partway along a length of the support portion; and a floating bush disposed about the support portion and located in a spaced apart relation to the support portion, the floating bush having a first end and a second end, the first end being located proximal to the second opposing side of the flanged portion; and a sleeve comprising:

a shank received between the floating bush and the support portion of the pin, the shank having a plurality of internal threads configured to releasably engage with the second threaded portion of the pin;

a stop flange disposed on an outer circumference of the shank and located proximal to the second end of the floating bush; and a polygonal head disposed on the outer circumference of the sleeve and located adjacent to the stop flange.

* * * * *